United States Patent [19]
Rucker

[11] Patent Number: 4,484,960
[45] Date of Patent: Nov. 27, 1984

[54] HIGH-TEMPERATURE-STABLE IGNITION POWDER

[75] Inventor: Klaus G. Rucker, Kinnelon, N.J.

[73] Assignee: E. I. Du Pont de Nemours and Company, Wilmington, Del.

[21] Appl. No.: 551,942

[22] Filed: Nov. 15, 1983

Related U.S. Application Data

[63] Continuation-in-part of Ser. No. 469,954, Feb. 25, 1983.

[51] Int. Cl.[3] ..... C06B 43/00; C06B 47/10
[52] U.S. Cl. ..... 149/22; 149/16; 149/35; 149/37; 149/105; 149/108.6; 102/202.5
[58] Field of Search ..... 149/22, 16, 35, 37, 149/105, 108.6; 102/202.5

[56] References Cited

U.S. PATENT DOCUMENTS 2,717,204 9/1955 Noddin et al. ..... 52/2
3,865,035 2/1975 Munson et al. ..... 102/364

*Primary Examiner*—Stephen J. Lechert, Jr.

[57] ABSTRACT

A mixture of about from 60 to 40 percent amorphous boron and about from 94 to 60 percent ferric oxide, useful as an ignition composition for electrically actuated blasting caps and squibs, has outstanding thermal stability, i.e., up to about 500° C. making it especially suitable for use in blasting caps in oil wells that are deep and hot, e.g., in the liquid-disabled cap described in U.S. patent application Ser. No. 469,954. Bridgewire-sensitive compositions containing about from 10 to 20 percent boron are preferred. The compositions can be self-grained, or they may be grained preferably with a water-soluble polymeric binder.

5 Claims, 1 Drawing Figure

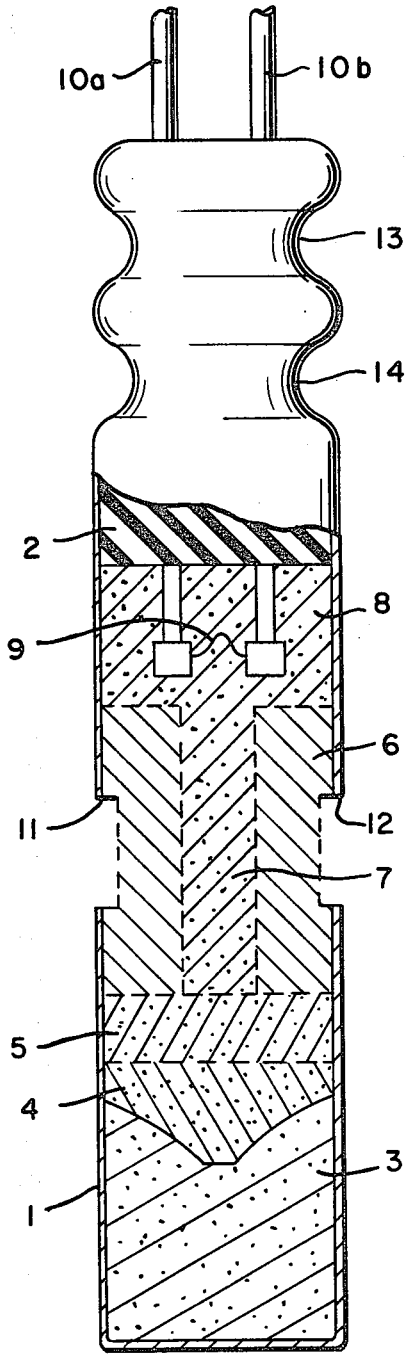
10a
10b
13
14
2
8
9
6
11
12
7
5
4
3
1

HIGH-TEMPERATURE-STABLE IGNITION POWDER

CROSS-REFERENCE TO RELATED APPLICATION

This application is a continuation-in-part of my co-pending application Ser. No. 469,954, filed Feb. 25, 1983.

BACKGROUND OF THE INVENTION

1. Field of the Invention

The present invention relates to ignition compositions especially adapted to be used in electrically actuated initiation devices such as blasting caps, squibs, and the like.

2. Description of the Prior Art

Electric blasting caps comprise a cylindrical metal shell containing a train of powder charges. In some designs, the cap is actuated by applying current to a pair of leg wires whose ends are joined together inside the cap by a short length of high-resistance wire called the "bridgewire", which is embedded in the cap's ignition mixture. The heat produced in the bridgewire causes the ignition mixture to ignite. A similar technique may be employed for actuating squibs.

The degree of sensitivity of the ignition charge to impact, friction, electrostatic charges, and flame is always a matter of concern to manufacturers and handlers of electroexplosive devices. Except for the need for sensitivity to ignition by a hot bridgewire, low sensitivity under all other conditions naturally is the primary goal. Typical heat-sensitive exothermic-burning compositions which have been used as the ignition charge in bridgewire-fired ignition assemblies include the complex salt of lead nitrate with a lead salt of a nitrophenol, a 50/25/25 mixture of smokeless powder/potassium chlorate/dibasic lead salt of a nitrophenol, mercury fulminate, lead styphnate, lead mononitroresorcinate, tetryl/lead styphnate compositions, a 2/98 boron/red lead mixture, red lead/manganese boride, lead/-selenium, etc.

An important consideration in the selection of the composition to be used as the ignition charge in an electric blasting cap is the environment to which the cap is to be exposed prior to being fired. Naturally, the composition must not decompose, or improper functioning, or non-functioning, may result. If the blasting cap is intended for use in oil wells that are deep and hot (for example, in systems designed to explosively perforate well casings and the wall of the oil well), consideration has to be given to the thermal stability of the ignition composition. As a rule, stability at temperatures up to about 350° C. is desirable for such uses. For oil well caps, metal/oxide ignition compositions are preferred because they are more stable at higher temperatures. However, if oil is absorbed into the ignition composition in the liquid-disabled blasting cap described in the above cross-referenced co-pending application Ser. No. 469,954, too vigorous a reaction may occur between an oxidizer such as red lead ($Pb_3O_4$) in a metal-/oxide ignition mixture and the absorbed hydrocarbons at the temperature attained by the hydrocarbon in the oil well, or at the temperature of the heated bridgewire. Therefore, a need exists for bridgewire-initiatable ignition compositions which are stable at high temperatures, e.g., at about 350° C. and above, and inert toward hot hydrocarbons.

SUMMARY OF THE INVENTION

This invention provides an ignition composition for an electroexplosive device such as a blasting cap, squib, or the like comprising a mixture of amorphous boron and ferric oxide ($Fe_2O_3$) in about a 6/94 to 40/60 parts ratio by weight.

Compositions of the invention containing at least about 10 percent boron by weight are preferred inasmuch as they can be initiated reliably by a hot bridgewire. Compositions containing less than about 10 percent boron by weight, while not reliably bridgewire-sensitive, are useful as transfer, or intermediate, ignition charges.

While most of the preferred $B/Fe_2O_3$ compositions of the invention are sufficiently sensitive for normal ignition by a hot bridgewire to serve as the primary ignition mix in a bridgewire-fired device, they are nevertheless extremely thermally stable, i.e., up to about 500° C. as well as insensitive to impact, friction, flame, and electrostatic discharges, thus making them eminently suited for use in hot oil wells.

BRIEF DESCRIPTION OF THE DRAWING

The accompanying drawing is a slide view in partial cross-section of an electrically actuated liquid-disabled blasting cap containing a composition of the invention as the ignition charge in a bridgewire-fired ignition assembly.

DETAILED DESCRIPTION

The ignition composition of the invention is a thermally ignitible composition which reacts exothermically, e.g., for the purpose of igniting a subsequent powder charge in a reaction train in an electric blasting cap. Although the composition may be thermally ignitible, i.e., by a hot bridgewire embedded therein, it is extremely stable to high ambient temperatures, as will be seen from the examples which follow.

The fuel component of the present ignition composition is amorphous boron, and the oxidizing component is ferric oxide ($Fe_2O_3$). The use of amorphous boron as fuel in boron/red lead ignition and delay compositions is well-known, and described, for example, in U.S. Pat. No. 2,717,204. Ferric oxide as the oxidizer in combination with boron, as occurs in the present composition, however, results in a composition of outstanding thermal stability, i.e., up to about 500° C., as compared to about 250° C. for prior art boron/oxidizer compositions.

The present composition contains at least about 6 percent by weight of boron, at least about 10 percent being preferred for the reason explained above. Compositions containing less than about 6 percent boron are not useful as ignition compositions because, even if ignitible with a hot bridgewire, they need to be in a densely compacted form in order to burn. While a boron content of up to about 40 percent by weight can be employed, more than about 20 percent usually is not preferred because bridgewire sensitivity is fairly constant above 15 percent boron, and the higher burning rate of high-boron compositions is not required in most high-temperature applications. Also, the high cost of amorphous boron makes an excessively high boron content economically unattractive. The size of the ferric oxide particles should be in the range of about from 0.2 to 1.2 micrometers in order to provide the maximum attainable strength of the binderless aggregation of the $B/Fe_2O_3$ powder. A preferred particle size is about 0.5 μm.

The present composition can be formed into coherent grains by slurrying amorphous boron and ferric oxide powder in water, mixing, forming a dried paste or crumbly mass, and forcing through a sieve. A graining agent is not required. Self-grained powders are preferred ignition charges in the previously mentioned liquid-disabled blasting cap described in the co-pending application Ser. No. 469,954, cross-referenced herein. As is stated in the co-pending application, the presence of a graining agent in the ignition charge may slow down the rate of fluid penetration therein and increase the disabling time. It may also reduce the thermal stability of the composition.

If a graining agent is to be used, e.g., to produce harder and larger grains than can be achieved by self-graining, water-soluble polymeric binders such as polyvinyl alcohol and sodium carboxymethylcellulose, generally in amounts of up to about 2 percent by weight, are preferred in the described liquid-disabled caps inasmuch as their effect on the liquid penetration rate is slight and they will admit aqueous liquids as well as oils. Where cap disablement by aqueous liquids is not required, the powders may be grained with polysulfide, polychloroprene, or silicone rubber in suitable organic liquids. Water-based mixing and graining methods are advantageous, however, because the moist or wet powder cannot be ignited by friction or electrostatic charges.

The preparation, testing, and utility of the ignition powder of the invention in electric blasting caps are illustrated by the following example.

EXAMPLE

The blasting cap shown in the drawing was made as follows: 1 was a standard blasting cap shell, e.g., a shell made of Type 5052 aluminum alloy, 4.7 cm long and having a 0.66-cm inner diameter. Shell 1 was integrally closed at one end and contained, in sequence from the integrally closed end, (a) a base charge 3 of a detonating explosive composition, in this case 450 milligrams of hexanitrostilbene, which had been placed in shell 1 and pressed therein at 890 Newtons with a pointed press pin; (b) a priming charge 4 of a heat-sensitive detonating explosive composition, in this case 320 milligrams of dextrinated lead azide, which had been loaded into shell 1 and pressed therein at 890 Newtons with a flat pin; and (c) a cover layer 5 of a heat-sensitive exothermic-burning ignition charge, which was loosely loaded into shell 1. Cover layer 5 consisted of the composition of the invention, in this case 130 milligrams of a 15/85 (parts by weight) mixture of self-grained boron/$Fe_2O_3$, which had been made by water-slurrying, drying, and then graining through a 20-mesh sieve (1-mm opening).

Seated within shell 1 over $B/Fe_2O_3$ cover layer 5 was a porous tube or cylinder 6, which in this case was a 9.5-millimeter-long cylinder made from fired, strand-extruded, crushable alumina and having a porosity of 35%. The outside diameter of cylinder 6 was 0.025–0.050 millimeter less than the inside diameter of shell 1, thereby enabling it to be gravity-loaded into the cap shell in loading machinery, and also to enable air to escape when the cap is submerged in liquid. The 2.5-mm-diameter axial perforation or bore of cylinder 6 contained a charge 7 of a heat-sensitive exothermic-burning composition which readily absorbs aqueous and/or organic liquids and is thereby rendered incapable of burning. Superposed on cylinder 6 was an electrical ignition assembly comprised of heat-sensitive exothermic-burning ignition charge 8 and the therein-embedded high-resistance bridgewire 9, which was attached to the ends of lead wires 10*a* and 10*b*. Charges 7 and 8 were loosely loaded and consisted of 320 milligrams of a 15/85 (parts by weight) mixture of self-grained boron/$Fe_2O_3$. Bridgewire 9 was a 0.038-mm-diameter nickel-chrome wire. The ignition end of the cap shell was closed by rubber sealing plug 2. Holes 11 and 12, 4.0 millimeters in diameter, were drilled through shell 1 at diametrically opposed locations so as to expose underlying circular areas of alumina cylinder 6.

Firing in Air

When a 0.44–0.50 ampere firing current was applied to 20 of the above-described blasting caps, all 20 of the caps detonated.

Thermal Stability

Forty of the above-described blasting caps were held at 260° C. for one hour, after which they were fired at the same temperature. All of the caps detonated fully, as was ascertained from the markings on aluminum witness plates.

Although the priming and base charges used in these caps give off gases at high temperatures, leading to premature excess internal pressure and blown plugs in unvented caps, the holes in the shell wall in the present cap allow the venting of gases, thereby increasing the temperature limit and the permitted time length of heat exposure of caps containing a cap-grade dextrinated lead azide priming charge and a hexanitrostilbene base charge.

Squibs in which a 0.048-mm-diameter nickel-chrome bridgewire was embedded in the 15/85 $B/Fe_2O_3$ ignition charge functioned well after 48 hours at 316° C., or 22 hours at 336° C.

Stability toward Humidity

Out of 100 of the above-described caps, 80 caps were maintained at 70° C. and 100% relative humidity for different periods of time. All 20 of the caps held under these conditions for 24 hours detonated; all 20 of the caps held under these conditions for 48 hours detonated, and all 40 of the caps held under these conditions for 10 days detonated. The other 20 caps of the 100-cap batch were fired in air immediately to establish the viability of the batch.

Subsequent tests on such caps have shown that the ignition powder will withstand six months of 100 percent relative humidity at 20° C.

Stability toward Electrostatic Energy

Forty of the above-described blasting caps were subjected to increasingly higher discharges of 4, 6, 8, 10, 15, 20 and 25 kilovolts from 900 picofarads in the double-leg to shell mode. None of the caps fired at 15 kilovolts or lower, 19 fired at 20 kilovolts, 18 fired at 25 kilovolts, and 3 did not fire. Thus, all 40 caps withstood 101 mWs (milliwat-seconds) energy and fired at 180 or 281 mWs.

In point-to-plate electrostatic tests on the 15/85 $B/Fe_2O_3$ powder in plastic tubing 1 mm in internal diameter, the powder was five times less sensitive than 1.7/98.3 $B/Pb_3O_4$ powder. It ignited with 16 mWs. A 10/90 $B/Fe_2O_3$ powder required 1500 mWs for ignition.

Reliability of Bridgewire Ignition

The 15/85 weight ratio of boron to ferric oxide used in the ignition composition of the above-exemplified blasting cap allowed the composition to be ignited reliably with a Ni-Cr bridgewire at a capacitor discharge firing energy of 10 mWs/ohm (0.5 A minimum firing current). This weight ratio is preferred. For a composition having a 12/88 weight ratio, 12 mWs/ohm was required with an 0.038-mm-diameter Ni-Cr wire, 20 mWs/ohm with an 0.043-mm-diameter Ni-Cr wire, 50 mWs/ohm with an 0.048-mm-diameter Ni-Cr wire, and 35 mWs/ohm with an 0.040-mm-diameter Pt-W wire. Minimum firing currents ranged from 0.4 to 0.8 ampere with bridgewires from 0.038 to 0.048 mm diameter for 15/85 $B/Fe_2O_3$.

Disablement by Salt Water

After 40 of the above-described blasting caps had been immersed in saturated salt water for less than two minutes, all 40 of the caps failed to detonate.

Disablement by Oil

After 40 of the above-described blasting caps had been immersed in kerosene for less than two minutes, all 40 of the caps failed to detonate.

A differential thermal analysis (DTA) trace of 15/85 $B/Fe_2O_3$ powder was flat to 500° C. and slightly rising at 600° C.

The same powder was unchanged in appearance and subsequent testing after heating in the open for one hour at 325° C.

Four different lots of the 15/85 $B/Fe_2O_3$ powder were drop tested and failed to ignite or burn when the 1-inch steel ball fell from 44 inches height. This was the maximum energy that the drop tester could impart on the powder.

Powder with a boron content between 6 and 20 percent cannot be ignited when a burning kitchen match is held against it. The powder flares up when a matchhead that is buried therein is flashed up with another burning match. This behavior is quite unexpected from a bridgewire-sensitive ignition powder. Conventionally used boron/red lead powders flash up within milliseconds when contacted by the match flame.

Likewise quite unexpected is the slow and laminar burning of the boron/ferric oxide powder. Although somewhat depending on the degree of compaction, powder in an open pile burns at a rate of less than 1 cm/sec. for 9 percent boron and about 3 cm/sec. for 20 percent boron. Such slow burning confers added protection in manufacturing these powders.

I claim:

1. An ignition powder for electrically actuated initiation devices comprising a mixture of boron and ferric oxide in about a 6/94 to 40/60 parts ratio by weight.

2. An ignition powder of claim 1 wherein the boron/ferric oxide ratio is about from 10/90 to 20/80 parts by weight.

3. An ignition powder of claim 2 wherein said mixture is substantially free of a graining agent.

4. An ignition powder of claim 2 containing up to about 2 percent by weight of a water-soluble polymeric binder as a graining agent.

5. An ignition powder of claim 2 in the ignition assembly of an electric blasting cap or squib and having embedded therein a 0.04 to 0.2 mm thick nickel-chrome bridgewire.

* * * * *